US009905153B2

(12) United States Patent
He et al.

(10) Patent No.: US 9,905,153 B2
(45) Date of Patent: Feb. 27, 2018

(54) GATE DRIVING CIRCUIT AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Quanhua He, Beijing (CN); Lingyun Shi, Beijing (CN); Hao Zhang, Beijing (CN); Chao Yu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/542,010

(22) PCT Filed: Sep. 26, 2016

(86) PCT No.: PCT/CN2016/100150
§ 371 (c)(1),
(2) Date: Jul. 6, 2017

(87) PCT Pub. No.: WO2017/121147
PCT Pub. Date: Jul. 20, 2017

(65) Prior Publication Data

US 2017/0372651 A1 Dec. 28, 2017

(30) Foreign Application Priority Data

Jan. 12, 2016 (CN) ..... 2016 1 0018638

(51) Int. Cl.
*G09G 3/20* (2006.01)

(52) U.S. Cl.
CPC ... *G09G 3/2085* (2013.01); *G09G 2300/0408* (2013.01); *G09G 2310/0283* (2013.01)

(58) Field of Classification Search
CPC ..... G09G 3/2085; G09G 2300/0408; G09G 2310/0283
See application file for complete search history.

(56) References Cited

U.S. PATENT DOCUMENTS

2009/0174692 A1* 7/2009 Park ..... G09G 3/3648 345/204
2010/0039423 A1* 2/2010 Jeong ..... G09G 3/3266 345/213

(Continued)

FOREIGN PATENT DOCUMENTS

CN 103761944 A 4/2014
CN 104240631 A 12/2014
CN 105448227 A 6/2016

OTHER PUBLICATIONS

The International Search Report and Written Opinion dated Dec. 30, 2016; PCT/CN2016/100150.

(Continued)

*Primary Examiner* — Ryan A Lubit
(74) *Attorney, Agent, or Firm* — Ladas & Parry LLP

(57) ABSTRACT

There are disclosed a gate driving circuit and a display device, which include: M areas, each area includes K sub driving circuit, and the k-th sub driving circuit includes: first and second row driving circuits, both of which include: a gate line grating control module (11) including a row control signal input terminal and an area grating signal input terminal, and an output terminal of the gate line grating control module (11) outputs a gate line grating signal according to received k-th and (k+1)-th row control signals and area grating signal; and a gate driving signal output module (12) including a gate line grating signal input terminal, a first- (Continued)

level driving signal input terminal and a second-level driving signal input terminal, and an output terminal of the gate driving signal output module (12) is connected to the gate line. The gate driving circuit can enhance flexibility of a scanning mode.

13 Claims, 5 Drawing Sheets

(56) References Cited

U.S. PATENT DOCUMENTS

| | | | | |
|---|---|---|---|---|
| 2011/0273434 | A1* | 11/2011 | Park | G09G 3/3225<br>345/213 |
| 2013/0002309 | A1* | 1/2013 | Lee | G09G 3/3677<br>327/108 |
| 2014/0204009 | A1* | 7/2014 | Kim | G09G 3/3677<br>345/92 |
| 2016/0055811 | A1* | 2/2016 | Zhu | G09G 3/3648<br>345/214 |
| 2016/0189677 | A1* | 6/2016 | Cao | G11C 19/287<br>345/691 |

OTHER PUBLICATIONS

The First Chinese Office Action dated Aug. 16, 2017; Appln. No. 201610018638.7

* cited by examiner

GATE DRIVING CIRCUIT AND DISPLAY DEVICE

The present application claims the priority of a Chinese patent application No. 201610018638.7 filed on Jan. 12, 2016. Herein the content disclosed by the Chinese patent application is incorporated in full by reference as a part of the present disclosure.

TECHNICAL FIELD

The present disclosure relates to a gate driving circuit and a display device.

BACKGROUND

At present, in a small-size display panel, in order to reduce the cost and realize a narrow-frame appearance, the gate driving circuit is formed on an array substrate to obtain a gate driver on array (GOA) model after being integrated. A gate is driven to be turned on progressively through a GOA timing signal. However, the existing GOA can only be scanned progressively, and frame distance of the narrow frame has been reduced to the limit. Thus, a new gate driving circuit is needed.

SUMMARY

There are provided in embodiments of the present application a gate driving circuit and a display device, which are used to increase diversity of scanning modes.

According to one aspect of the present disclosure, there is provided a gate driving circuit, comprising: M areas, each of which comprises K sub driving circuit, is connected externally to 2K gate lines, and shares (K+1) row control signals, wherein a k-th sub driving circuit is connected externally to a (2k−1)-th gate line and a 2k-th gate line, and the k-th sub driving circuit receives a k-th row control signal and a (k+1)-th row control signal; where the M and K are positive integers greater than 1, $1 \le k \le K$;

the k-th sub driving circuit comprises: a first row driving circuit and a second row driving circuit connected externally to the (2k−1)-th gate line and the 2k-th gate line respectively, and each of the first row driving circuit and the second row driving circuit includes: a gate line grating control module and a gate driving signal output module;

the gate line grating control module comprises a row control signal input terminal and an area grating signal input terminal, and an output terminal of which outputs a gate line grating signal according to received k-th row control signal and (k+1)-th row control signal and area grating signal; and the gate driving signal output module comprises a gate line grating signal input terminal, a first-level driving signal input terminal and a second-level driving signal input terminal, and an output terminal of the gate driving signal output module is connected to the gate line, if a logic value indicated by a received gate line grating signal is 1, then the gate driving signal output module outputs a first-level driving signal, and otherwise the gate driving signal output module outputs a second-level driving signal.

According to another aspect of the present disclosure, there is provided a display device, comprising the gate driving circuit as described above.

Solutions of the embodiments of the present disclosure provide a new gate driving circuit, which adopts a mode of controlling which gate line to be turned on by means of dividing areas of the gate line and additionally by using the area grating signal and the row control signal, every two adjacent row control signals can control two gate lines to be turned on or turned off, and can adjust the area grating signal and the row control signal according to the requirements, to carry out scanning of all the gate lines in a certain area or carry out scanning of some gate lines in the area, so that flexibility of scanning modes are improved.

DETAILED DESCRIPTION

In order to make principles and advantages of embodiments of the present disclosure more clear, the embodiments of the present disclosure will be described below clearly and completely by combining with figures. Obviously, the embodiments described below are just a part of embodiments of the present disclosure, but not all the embodiments of the present disclosure.

Figure 1:
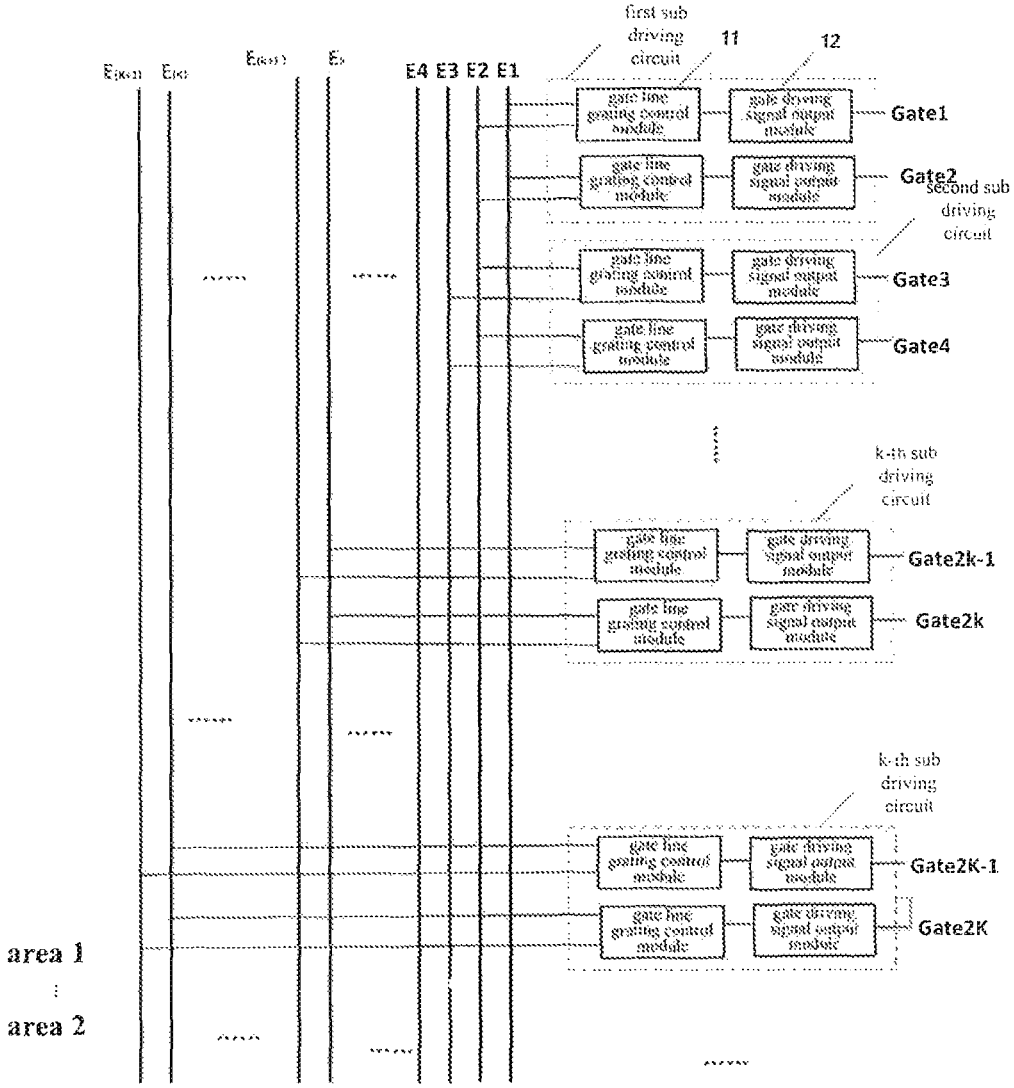
FIG. 1 is a structure schematic diagram of a gate driving circuit provided in an embodiment of the present disclosure.

FIG. 1 shows a structure schematic diagram of a gate driving circuit provided in an embodiment of the present disclosure.

As shown in FIG. 1, the gate driving circuit comprises: M areas, each of which comprises K sub driving circuits, is connected externally to 2K gate lines, and shares (K+1) paths of row control signals, wherein a k-th sub driving circuit is connected externally to a (2k−1)-th gate line and a 2k-th gate line, and a k-th sub driving circuit receives a k-th row control signal and a (k+1)-th row control signal, where M and K are positive integers greater than 1, $1 \le k \le K$.

For example, for a Full High Definition (FHD) resolution, it needs 1920 gate lines. When the gate driving circuit is divided into M=10 areas, each area needs to be connected externally to 192 gate lines. Respective areas share 97 row control signals.

The k-th sub driving circuit comprises: a first row driving circuit and a second row driving circuit connected externally to a (2k−1)-th gate line and a 2k-th gate line, each of the first row driving circuit and the second row driving circuit including: a gate line grating control module 11 and a gate driving signal output module 12.

The gate line grating control module 11 comprises a row control signal input terminal and an area grating signal input terminal, and an output terminal of the gate line grating control module outputs a gate line grating signal according to received k-th row control signal, (k+1)-th row control signal and area grating signal.

The gate driving signal output module 12 comprises a gate line grating signal input terminal, a first-level driving signal input terminal and a second-level driving signal input terminal, and an output terminal of the gate driving signal output module is connected to the gate line, if a logic value indicated by a received gate line grating signal is 1, then the gate driving signal output module outputs the first-level driving signal, otherwise the gate driving signal output module outputs the second-level driving signal.

The first-level driving signal and the second-level driving signal are voltage signals needed for turning on and turning off a TFT on a substrate, while the area grating signal and the row control signal are voltage signals for controlling the gate line grating control module to be in an operation state or in a non-operation state. Generally, a voltage value of the first-level driving signal or the second-level driving signal is greater than a voltage value of the area grating signal and the row control signal.

In the above solution, very two adjacent paths of the row control signals can be controlled through a logic value 0 or 1 to output two kinds of different gate line grating signals. If a logic value of a first row control signal is 1, then switching of a TFT connected to a first gate line and a second gate line is controlled by controlling a logic value of a second gate line as 0 or 1. When the logic value of the first row control signal is 0, the TFT connected to the first gate line and the second gate line is turned off and maintained as the second-level driving signal (VGL). When the logic value of the second row control signal is 1, the switching of a TFT connected to a third gate line and a fourth gate line is controlled by controlling a logic value of the third row control signal as 0 or 1; and so on and so forth. In addition, at each moment, there could be only two paths of row control signals at maximum whose logic values are 1, and there could be one row control signal at minimum which is high.

The solution of the embodiment of the present disclosure provides a new gate driving circuit, which can adjust the area grating signal and the row control signal as required to carry out scanning of all the gate lines in a certain area or carry out scanning of some designated gate lines in the area by means of dividing the gate lines into areas and additionally by using a mode of controlling which gate line to be turned on by the area grating signal and the row control signal, so that it is easier to control turn-on and turn-off of the TFTs connected to the gate lines, and thus flexibility of scanning modes are improved.

The aforesaid gate driving circuit can be integrated in the driver integrated circuit (Driver IC). Compared with the existing GOA, since the gate driving circuit is integrated in the Driver IC, it does not need to carry out integration of the gate driving circuit on the panel. Therefore, the width of the frame is reduced. Furthermore, compared with the existing GOA, the yield rate of the display panel is increased. In the existing GOA, since it is formed on the array substrate, in the process of manufacturing the array substrate, the forming process of the gate driving circuit is added. When a problem occurs to the gate driving circuit, it means that a problem occurs to the array substrate, which resulting in reduction of the yield rate of the array substrate. The solution of the embodiment of the present disclosure is not forming a gate driving circuit on the array substrate, so that the yield rate of the display panel is increased.

The above area grating signal and the row control signal can be output by the Driver IC. For example, the area grating signal and the row control signal can be obtained through a signal output by a vacant pin on the Driver IC.

The first-level driving signal and the second-level driving signal can also be output by the Driver IC.

In the solution of the embodiment of the present disclosure, the gate driving circuit is divided into areas, each of which is controlled by the area grating signal, and the operation state of respective areas is controlled. When it needs to ensure that only one area is in the operation state at a same moment, each area can be allocated a unique area grating signal.

Figure 2:
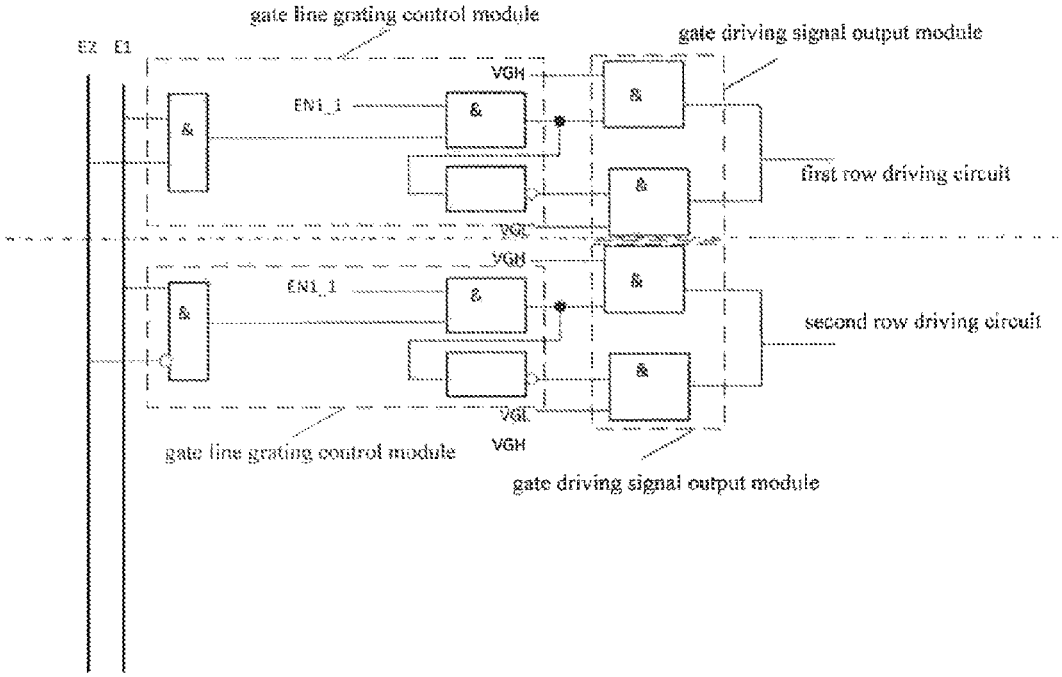
FIG. 2 is a structure schematic diagram of a sub driving circuit of a gate driving circuit provided in an embodiment of the present disclosure.

FIG. 2 shows a structure schematic diagram of a sub driving circuit of a gate driving circuit provided in an embodiment of the present disclosure.

For example, in the sub driving circuit as shown in FIG. 2, the gate driving signal output module comprised in the first row driving circuit can comprise:

a first AND gate, whose first input terminal receives a first-level driving signal VGH, second input terminal receives a gate line grating signal output by the gate line grating control module, and output terminal is connected externally to a gate line;

a second AND gate, whose first input terminal receives a second-level driving signal VGL, and output terminal is connected externally to the gate line; and a NOT gate, whose input terminal is connected to an output terminal of the gate line grating control module, and output terminal is connected to a second input terminal of the second AND gate.

Alternatively, the gate line grating control module comprised in the first row driving circuit can comprise:

a third AND gate, whose first input terminal and a second input terminal receive a k-th row control signal (for example E1 as shown in FIG. 2) and a (k+1)-th row control signal (for example, E2 as shown in FIG. 2), and output terminal is connected to a first input terminal of a fourth AND gate; and the fourth AND gate, whose second input terminal receives an area grating control signal (for example, EN1_1 as shown in FIG. 2), and output terminal outputs the gate line grating control signal.

Similarly, in the sub driving circuit as shown in FIG. 2, the gate driving signal output module comprised in the second row driving circuit can comprise:

a first AND gate, whose first input terminal receives the first level driving signal VGH, second input terminal receives the gate line grating signal output by the gate line grating control module, and output terminal is connected externally to the gate line;

a second AND gate, whose first input terminal receives the second-level driving signal VGL, and the output terminal is connected externally to the gate line; and a NOT gate, whose input terminal is connected to the output terminal of the gate line grating control module, and output terminal is connected to a second input terminal of a sixth AND gate.

Alternatively, the gate line grating control module comprised in the second row driving circuit can comprise:

a NOT gate, whose input terminal receives the (k+1)-th row control signal (for example, E2 as shown in FIG. 2), and output terminal is connected to a second input terminal of a fifth AND gate;

the fifth AND gate, whose first input terminal receives the k-th row control signal (for example, E1 as shown in FIG. 2), and output terminal is connected to a first input terminal of a sixth AND gate; and the sixth AND gate, whose second input terminal receives the area grating control signal (for example, EN1_1 as shown in FIG. 2), and output terminal outputs the gate line grating control signal.

It is shown completely in FIG. 2 the circuit comprising the first AND gate to the sixth AND gate and the NOT gate as described above. As shown in FIG. 2, it can be noted that in the gate line grating control module comprised in the second row driving circuit as shown in FIG. 2, the fifth AND gate has been incorporated with the "NOT" gate. For this reason, a circle is added to the input terminal of the fifth AND gate, and is used to indicate that a logic value input to the input terminal is firstly carried out NOT operation and then the logic value obtained by carrying out the NOT operation and logic values input by other input terminals are carried out AND operation.

It can be known from characteristics of the logic circuit per se that there are many logic circuits being capable of implementing the gate line grating control module and the gate driving signal output module in the embodiment of the present application. FIG. 2 just gives a simpler implementation mode. Obviously, the specific circuit structure of the gate driving signal output module and the gate line grating control module in the embodiment of the present disclosure are not limited to the circuit as shown in FIG. 2.

The above solutions of the embodiments of the present disclosure can be realized by using the logic circuits, and the row control signals are formed by the logic signals. The solutions of the embodiments of the present application are further described by taking examples.

Figure 3:
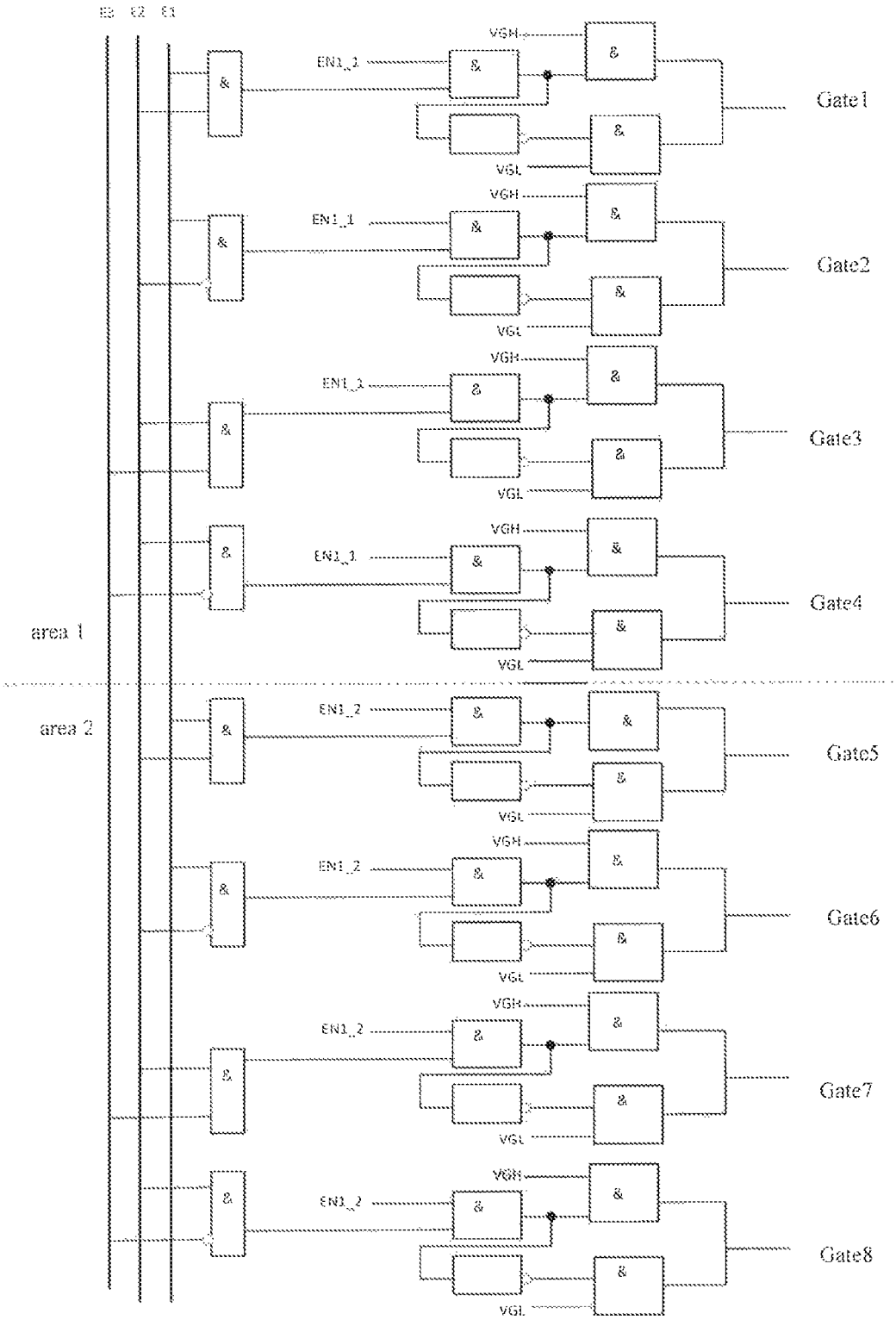
FIG. 3 is a structure schematic diagram of another gate driving circuit provided in a embodiment of the present disclosure.

FIG. 3 shows a structure schematic diagram of another gate driving circuit provided in an embodiment of the present disclosure.

In the embodiment as shown in FIG. 3, it will be described by taking a gate driving circuit which has 2 divided areas, each area being connected externally to 4 gate lines, and sharing 2 row control signals as an example.

As shown in FIG. 3, in an area 1, the first sub driving circuit is connected externally to a first gate line Gate1 and a second gate line Gate2, and the first sub driving circuit receives the first row control signal E1 and the second row control signal E2; a second sub driving circuit is connected externally to a third gate line Gate3 and a fourth gate line Gate4, and the second sub driving circuit receives the second row control signal E2 and the third row control signal E3.

In an area 2, the first sub driving circuit is connected externally to a first gate line Gate5 and a second gate line Gate6 in the area, and the first sub driving circuit receives the first row control signal E1 and the second row control signal E2; the second sub driving circuit is connected externally to a third gate line Gate7 and a fourth gate line Gate8 in the area, and the second sub driving circuit receives the second row control signal E2 and the third row control signal E3.

Figure 4:
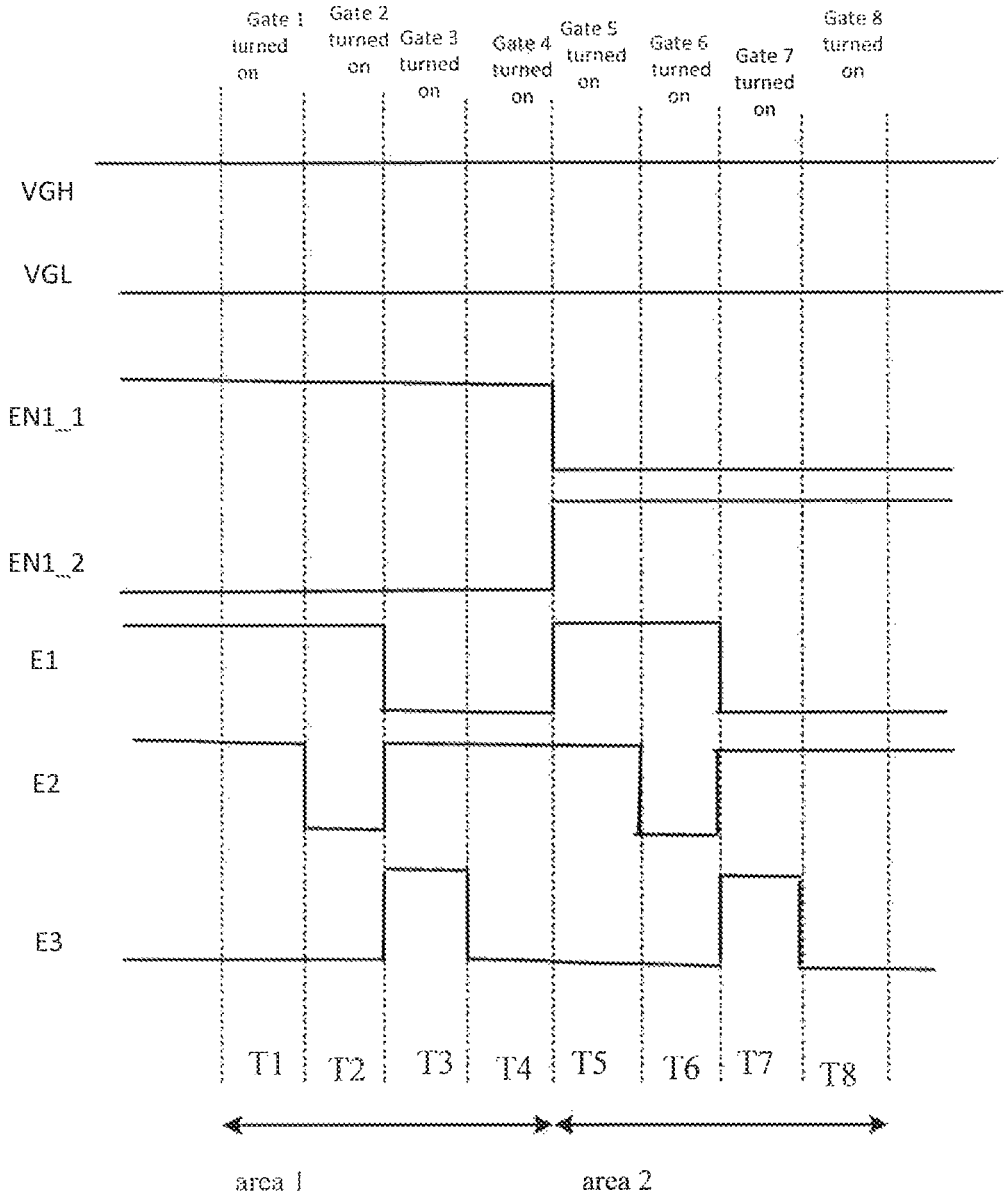
FIG. 4 is an operation timing diagram of a gate driving circuit provided in an embodiment of the present disclosure.

FIG. 4 shows an operation timing diagram of the gate driving circuit as shown in FIG. 3. As shown in FIG. 4, VGH in FIG. 4 represents a first-level driving signal, VGL represents a second-level driving signal, EN1 is a signal for controlling areas. If the logic value of EN1_1 is 1, then it indicates that the TFT on the gate line connected externally to the first area can be turned on; if a logic value of EN1_1 is 0, then it indicates that a TFT on the gate line connected externally to the first area can be turned off. If a logic value of EN1_2 is 1, then it indicates that a TFT on a gate line connected externally to a second area can be turned on; if the logic value of EN1_2 is 0, then it indicates that the TFT on the gate line connected externally to the second area can be turned off.

By inputting the timings in FIG. 4 to the circuit as shown in FIG. 3, Gate1 to Gate8 can be turned on sequentially. Since the logic circuit is simple relatively, in respective phases, a level signal output from the Gate1 can be obtained by inputting a corresponding timing in FIG. 3 according to an arithmetic rule of the logic circuit. When inputting is carried out specifically, the VGH can be taken as having the logic value of 1, and the VGL can be taken as having the logic value of 0. No further description is given herein.

There is further provided in an embodiment of the present disclosure a display device. The display device can comprise any one of the gate driving circuits provided in the embodiments as described above.

Alternatively, a display panel of the display device comprises at least two sub display areas. Gate lines of each sub display area are mutually independent of each other and are corresponding to one of the gate driving circuit as described above.

Figure 5:
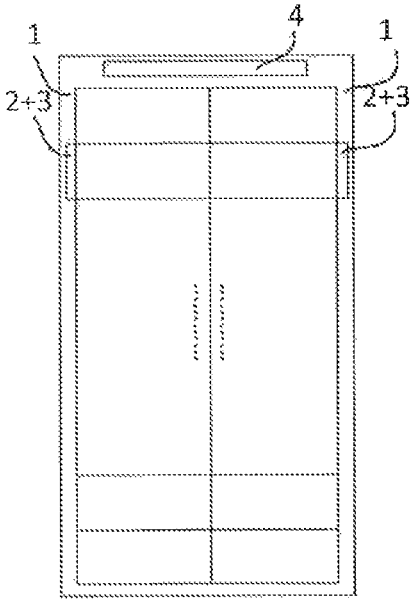
FIG. 5 is a structure schematic diagram of a display panel provided in an embodiment of the present disclosure.

FIG. 5 shows a structure schematic diagram of a display panel provided in an embodiment of the present disclosure.

FIG. 5 gives a schematic diagram of one sub display area included respectively on two sides of the display panel, and each side has an area grating signal and a row control signal (herein, when the display panel is manufactured, gate lines of each row are divided into two segments). At this time, enable signals on the left and right sides control pixel units corresponding to half data signals on the left and right sides respectively to be charged and discharged. By controlling a half of pixels by the enable signals on the left and right sides respectively, the data signals only need to be refreshed a half in real time when a special pattern is displayed (for example, when it needs to display patterns in a scenario of splitting screen display), which reduces power consumption. In FIG. 5, 1 represents the area grating signal, 2 represents the row control signal, 3 represents the first-level driving signal and the second-level driving signal, and 4 represents Driver IC.

In addition, two gate driving circuits can be disposed on the display panel, and one gate driving circuit is disposed on the left and right sides respectively. Herein, one gate driving circuit controls one half of gate lines on the display panel of the display device, and the other gate driving circuit controls another half of gate lines on the display panel of the display device. At this time, the number of row control signals on each side can be reduced. For example, in the case of FHD resolution, as described above, it requires 1920 gate lines, when it is divided into 10 areas, there are 192 rows of gate lines within each area. Each side of the display panel needs to control at least 96 gate lines. Therefore, each side needs 96/2+1=49 row control lines at minimum.

Exemplarily, an odd-numbered row of gate lines of the display panel of the display device can be controlled by one gate driving circuit, and an even-numbered row of gate lines of the display panel of the display device can be controlled by another gate driving circuit. The specific control timing can be designed according to the requirement for the gating of the odd-numbered row of gate lines and the even-numbered row of gate lines. By using this solution, the flexibility of scanning can be increased, and the gate driving circuit that controls the odd-numbered row of gate lines of the display panel of the display device is started up when only the odd-numbered row of gate lines need to be scanned; and the gate driving circuit that controls the even-numbered row of gate lines of the display panel of the display device is started up when only the even-numbered row of gate lines needs to be scanned. When it needs to scan sequentially, the two gate driving circuits are matched with each other to be used.

Obviously, those skilled in the art can make various alternations and modifications to the present disclosure without departing from the principle and scope of the present disclosure. As such, if these alternations and modifications of the present disclosure belong to the scope of the claims of the present disclosure, then the present disclosure intends to include these alternations and modifications.

What is claimed is:

1. A gate driving circuit, comprising: M areas, each of which comprises K sub driving circuit, is connected externally to 2K gate lines, and shares (K+1) row control signals, wherein a k-th sub driving circuit is connected externally to a (2k−1)-th gate line and a 2k-th gate line, and the k-th sub driving circuit receives a k-th row control signal and a (k+1)-th row control signal; where M and K are positive integers greater than 1, $1 \leq k \leq K$;

the k-th sub driving circuit comprises: a first row driving circuit and a second row driving circuit connected externally to the (2k−1)-th gate line and the 2k-th gate line respectively, and each of the first row driving circuit and the second row driving circuit includes: a gate line grating control module and a gate driving signal output module, wherein:

the gate line grating control module comprises a row control signal input terminal and an area grating signal input terminal, and an output terminal of the gate line grating control module outputs a gate line grating signal according to received k-th row control signal, (k+1)-th row control signal and area grating signal; and the gate driving signal output module comprises a gate line grating signal input terminal, a first-level driving signal input terminal and a second-level driving signal input terminal, and an output terminal of the gate driving signal output module is connected to the gate line, if a logic value indicated by a received gate line grating signal is 1, then the gate driving signal output module outputs a first-level driving signal, otherwise the gate driving signal output module outputs a second-level driving signal.

2. The gate driving circuit according to claim 1, wherein the gate driving signal output module comprises:

a first AND gate, whose first input terminal receives a first-level driving signal, second input terminal receives a gate line grating signal output by the gate line grating control module, and output terminal is connected externally to a gate line;

a second AND gate, whose first input terminal receives a second-level driving signal VGL, and output terminal is connected externally to the gate line; and a NOT gate, whose input terminal is connected to an output terminal of the gate line grating control module, and output terminal is connected to a second input terminal of the second AND gate.

3. The gate driving circuit according to claim 1, wherein the gate line grating control module of the first row driving circuit comprises:

a third AND gate, whose first input terminal and a second input terminal receive a k-th row control signal and a (k+1)-th row control signal respectively, and output terminal is connected to a first input terminal of a fourth AND gate; and the fourth AND gate, whose second input terminal receives an area grating control signal, and output terminal outputs the gate line grating control signal.

4. The gate driving circuit according to claim 1, wherein the gate line grating control module of the second row driving circuit comprises:

a NOT gate, whose input terminal receives the (k+1)-th row control signal, and output terminal is connected to a second input terminal of a fifth AND gate;

the fifth AND gate, whose first input terminal receives the k-th row control signal, and output terminal is connected to a first input terminal of a sixth AND gate; and the sixth AND gate, whose second input terminal receives the area grating control signal, and output terminal outputs the gate line grating control signal.

5. A display device, comprising the gate driving circuit according to claim 1.

6. The display device according to claim 5, wherein a display panel of the display device comprises at least two sub display areas, gate lines of each sub display area are mutually independent of each other and are corresponding to one of the gate driving circuit as described above.

7. The display device according to claim 6, comprising two gate driving circuits, one of which controls odd-numbered row of gate lines of the display panel of the display device, and the other of which controls even-numbered row of gate lines of the display panel of the display device.

8. The gate driving circuit according to claim 2, wherein the gate line grating control module of the first row driving circuit comprises:

a third AND gate, whose first input terminal and a second input terminal receive a k-th row control signal and a (k+1)-th row control signal respectively, and output terminal is connected to a first input terminal of a fourth AND gate; and the fourth AND gate, whose second input terminal receives an area grating control signal, and output terminal outputs the gate line grating control signal.

9. The gate driving circuit according to claim 2, wherein the gate line grating control module of the second row driving circuit comprises:

a NOT gate, whose input terminal receives the (k+1)-th row control signal, and output terminal is connected to a second input terminal of a fifth AND gate;

the fifth AND gate, whose first input terminal receives the k-th row control signal, and output terminal is connected to a first input terminal of a sixth AND gate; and the sixth AND gate, whose second input terminal receives the area grating control signal, and output terminal outputs the gate line grating control signal.

10. The gate driving circuit according to claim 3, wherein the gate line grating control module of the second row driving circuit comprises:

a NOT gate, whose input terminal receives the (k+1)-th row control signal, and output terminal is connected to a second input terminal of a fifth AND gate;

the fifth AND gate, whose first input terminal receives the k-th row control signal, and output terminal is connected to a first input terminal of a sixth AND gate; and the sixth AND gate, whose second input terminal receives the area grating control signal, and output terminal outputs the gate line grating control signal.

11. The display device according to claim 5, wherein the gate driving signal output module comprises:

a first AND gate, whose first input terminal receives a first-level driving signal, second input terminal receives a gate line grating signal output by the gate line grating control module, and output terminal is connected externally to a gate line;

a second AND gate, whose first input terminal receives a second-level driving signal VGL, and output terminal is connected externally to the gate line; and a NOT gate, whose input terminal is connected to an output terminal of the gate line grating control module, and output terminal is connected to a second input terminal of the second AND gate.

12. The display device according to claim 5, wherein the gate line grating control module of the first row driving circuit comprises:

a third AND gate, whose first input terminal and a second input terminal receive a k-th row control signal and a (k+1)-th row control signal respectively, and output terminal is connected to a first input terminal of a fourth AND gate; and the fourth AND gate, whose second input terminal receives an area grating control signal, and output terminal outputs the gate line grating control signal.

13. The display device according to claim 5, wherein the gate line grating control module of the second row driving circuit comprises:

a NOT gate, whose input terminal receives the (k+1)-th row control signal, and output terminal is connected to a second input terminal of a fifth AND gate;

the fifth AND gate, whose first input terminal receives the k-th row control signal, and output terminal is connected to a first input terminal of a sixth AND gate; and the sixth AND gate, whose second input terminal receives the area grating control signal, and output terminal outputs the gate line grating control signal.

* * * * *